US010561259B1

(12) United States Patent
Gaspari

(10) Patent No.: US 10,561,259 B1
(45) Date of Patent: Feb. 18, 2020

(54) NECK PILLOW APPARATUS

(71) Applicant: Seda Gaspari, Los Angeles, CA (US)

(72) Inventor: Seda Gaspari, Los Angeles, CA (US)

( * ) Notice: Subject to any disclaimer, the term of this patent is extended or adjusted under 35 U.S.C. 154(b) by 0 days.

(21) Appl. No.: 16/434,107

(22) Filed: Jun. 6, 2019

(51) Int. Cl.
*A47G 9/10* (2006.01)
*A47G 9/02* (2006.01)

(52) U.S. Cl.
CPC ..... *A47G 9/109* (2013.01); *A47G 9/0253* (2013.01); *A47G 2009/1018* (2013.01)

(58) Field of Classification Search
CPC ..... A47G 9/0253
See application file for complete search history.

(56) References Cited

U.S. PATENT DOCUMENTS 4,550,459 A * 11/1985 Endel ..... A47G 9/10 5/640
4,754,513 A 7/1988 Rinz
4,756,035 A 7/1988 Beier
4,768,248 A 9/1988 O'Sullivan
4,956,886 A * 9/1990 Sarkozi ..... A47G 9/10 5/636
5,020,174 A * 6/1991 Sarkozi ..... A47G 9/10 5/640
5,586,350 A * 12/1996 Thonnessen ..... A47C 31/001 5/636
D439,464 S * 3/2001 Shuster ..... D6/596
7,832,034 B2 * 11/2010 Liu ..... A47G 9/10 5/490
8,276,227 B2 * 10/2012 Pileggi ..... A47G 9/1081 5/630
D706,062 S 6/2014 Murray et al.
8,813,283 B2 8/2014 Alexander
2010/0077551 A1 * 4/2010 Liu ..... A47G 9/0253 5/636
2011/0061166 A1 * 3/2011 Liu ..... A47G 9/0253 5/636
2011/0145994 A1 * 6/2011 Pileggi ..... A47G 9/1081 5/655.3
2011/0271453 A1 * 11/2011 Gandhi ..... A47G 9/1081 5/640
2014/0000034 A1 * 1/2014 Alexander ..... A47G 9/1081 5/636

(Continued)

*Primary Examiner* — Eric J Kurilla
(74) *Attorney, Agent, or Firm* — Entralta P.C.; Justin G. Sanders; Peter D. Weinstein

(57) ABSTRACT

A neck pillow apparatus is disclosed and configured for being selectively positionable and removably engagable with a main pillow. In at least one embodiment, the apparatus provides a substantially cylindrical pillow portion sized and configured for supporting a neck of a user in either a supine position or side position. The pillow portion also provides a cushion. An engagement portion is connected to the pillow portion at an at least one point on or substantially proximal to a lateral centerline of the pillow portion, the engagement portion configured for being selectively wrapped longitudinally around the main pillow. During use of the apparatus, the pillow portion is capable of being selectively positionable relative to the main pillow so as to comfortably provide proper neutral cervical alignment and support to the neck of the user, regardless of whether the user is laying in a supine position or side position.

20 Claims, 4 Drawing Sheets

(56) References Cited

U.S. PATENT DOCUMENTS

| | | | | |
|---|---|---|---|---|
| 2014/0115787 | A1* | 5/2014 | Garcia | A47G 9/1081 5/636 |
| 2015/0230635 | A1* | 8/2015 | Abrams | A47G 9/1081 5/636 |

* cited by examiner

NECK PILLOW APPARATUS

RELATED APPLICATIONS

Not applicable.

BACKGROUND

The subject of this patent application relates generally to pillows, and more particularly to a neck pillow apparatus configured for being selectively positionable and removably engagable with a main pillow, thereby adding proper neck support to the main pillow in a position that is ideal for the associated user—providing neutral cervical alignment and support to the user's neck both when the user is lying in a supine position or a side position.

Applicant hereby incorporates herein by reference any and all patents and published patent applications cited or referred to in this application.

By way of background, many people experience neck and back pain (along with a number of other symptoms) which can be linked to improper sleeping positions. Specifically, these people often require extra support in their pillows for providing neutral cervical alignment and neck support. Many different types of cervical support pillows have been developed in an attempt to solve these problems. Typically, such cervical support pillows provide a main pillow—sized and configured for supporting the user's head—along with a cervical support pillow—sized and configured for supporting the user's neck—attached thereto. While such pillows might provide users with the necessary support, they are often relatively large, expensive and difficult to travel with. U.S. Pat. No. 7,832,034 to Liu et al. has attempted to solve those problems by providing a pillow cover with neck support that is configured for removably receiving a traditional pillow, thereby allowing the user to use his or her own pillow (for head support) in conjunction with the Liu et al. neck support pillow (for neck support). However, the design of the Liu et al. apparatus is such that users are typically only able to obtain the necessary neck support when laying in a supine position, as illustrated in FIG. 2 of the '034 patent—and even then, not every user will be able to obtain the necessary support based on the design of the Liu et al. apparatus (particularly, in light of the retention pocket for the neck supporting element being attached to the pillow cover along two opposing longitudinal edges of the retention pocket). Additionally, the design of the Liu et al. apparatus renders it incapable of removably receiving traditional pillows of any size or shape, but rather only traditional pillows that are sized and shaped for fitting within its pillow cavity.

Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a neck pillow apparatus configured for being selectively positionable and removably engagable with a main pillow. In at least one embodiment, the apparatus provides a substantially cylindrical pillow portion sized and configured for supporting a neck of a user in either a supine position or side position. The pillow portion also provides a cushion. An engagement portion is connected to the pillow portion at an at least one point on or substantially proximal to a longitudinally extending centerline of the pillow portion, thereby allowing the pillow portion to closely pivot longitudinally about the centerline relative to the engagement portion, the engagement portion configured for being selectively wrapped laterally around the main pillow, such that the pillow portion is oriented substantially horizontal relative to the main pillow. During use of the apparatus, the pillow portion is capable of being selectively positionable between opposing lateral first and second edges of the main pillow so as to comfortably provide proper neutral cervical alignment and support to the neck of the user, regardless of whether the user is laying in a supine position or side position.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
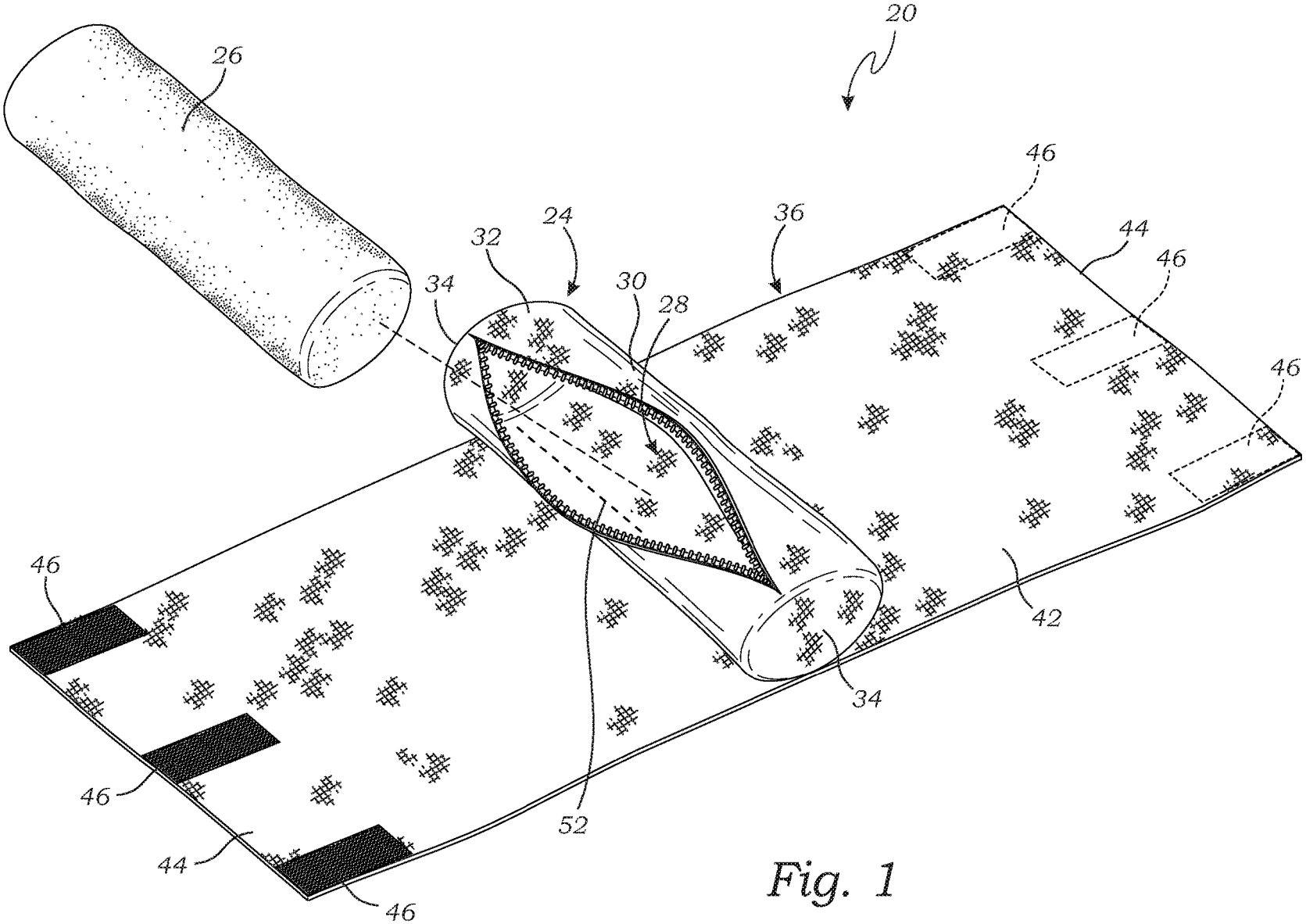
FIG. 1 is a perspective view of an exemplary neck pillow apparatus, showing an exemplary cushion exploded therefrom, in accordance with at least one embodiment.
Figure 4:
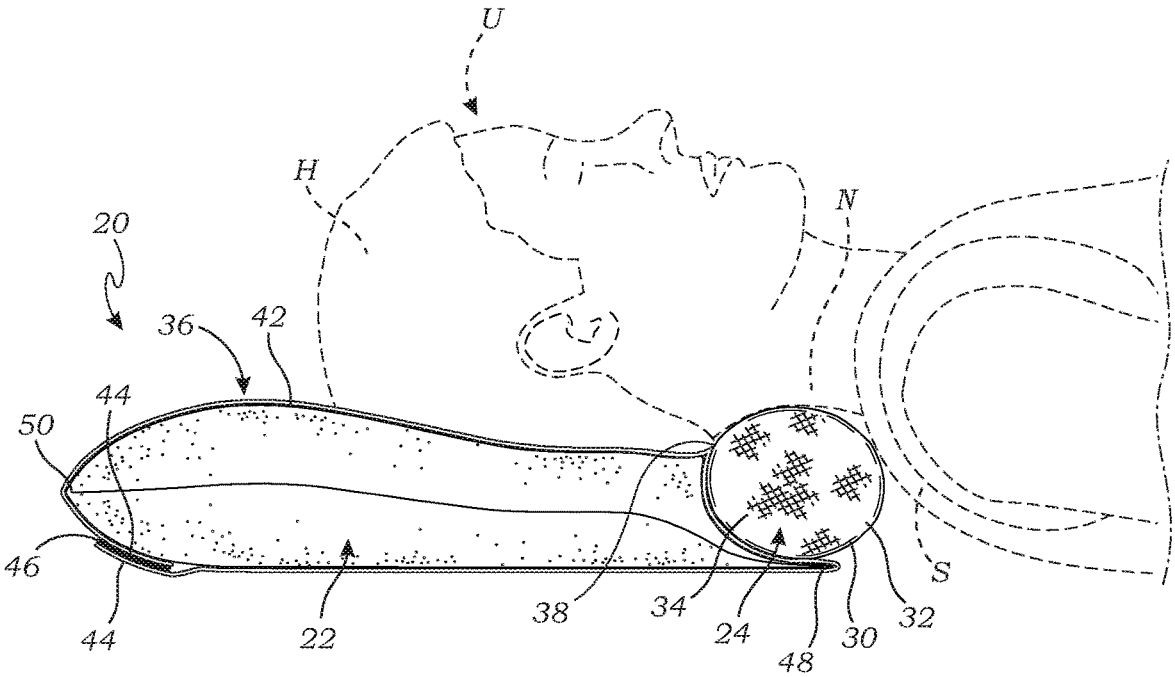
FIGS. 4 and 5 are further side views thereof, illustrating the exemplary neck pillow apparatus in use, in accordance with at least one embodiment.
Figure 5:
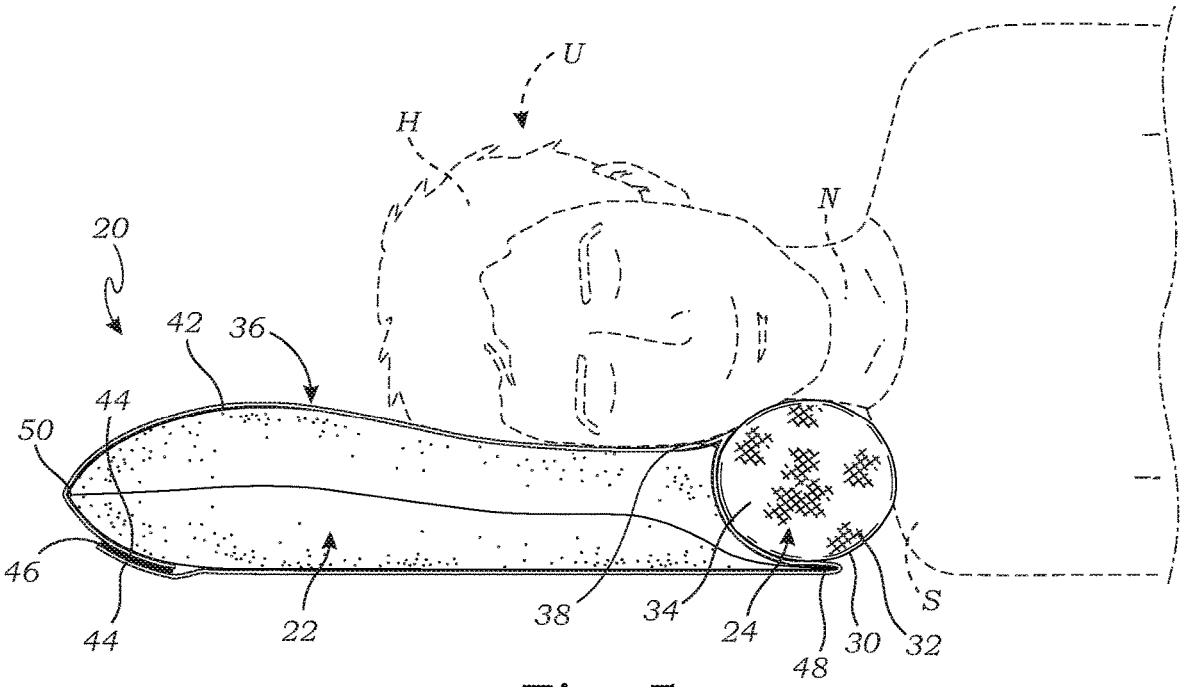
Figure 6:
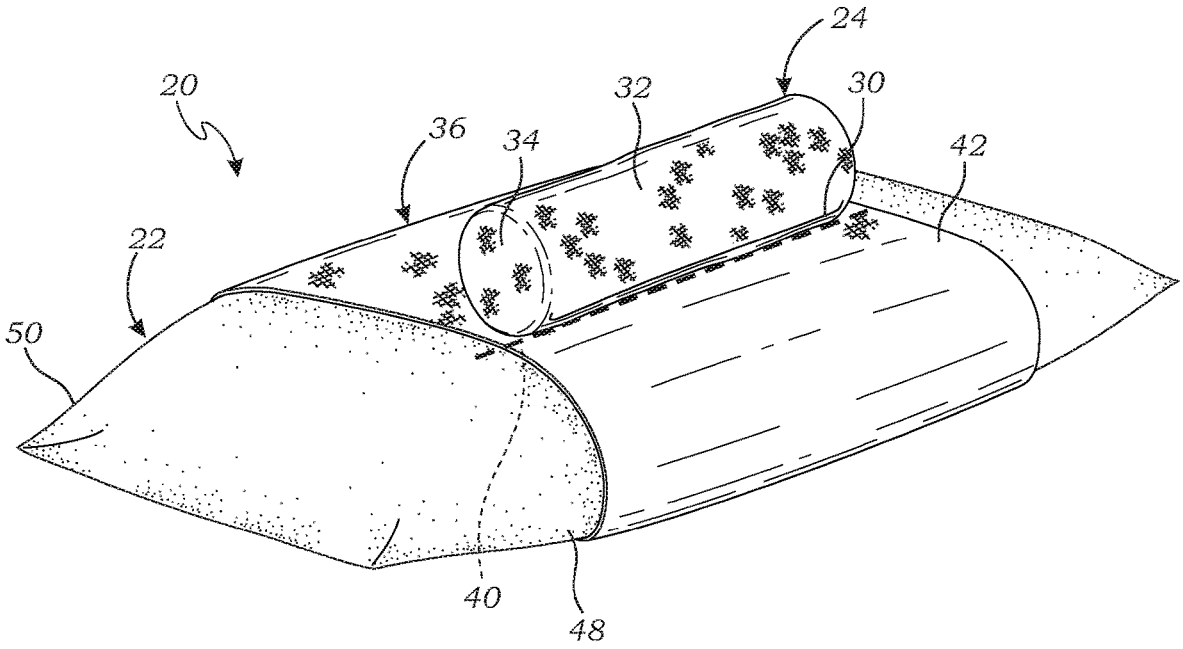
FIG. 6 is a further perspective view of the exemplary neck pillow apparatus removably engaged with a main pillow, in accordance with at least one embodiment.

Turning now to FIG. 1, there is shown a perspective view of an exemplary embodiment of a neck pillow apparatus 20 configured for being selectively positionable and removably engagable with a main pillow 22. At the outset, it should be noted that the term "main pillow" as used herein is intended to mean any pillow—now known or later developed—that does not itself provide a neck support portion. In at least one embodiment, the apparatus 20 provides a substantially cylindrical pillow portion 24 sized and configured for supporting a neck N of a user U in either a supine position (FIGS. 4 and 7) or side position (FIG. 5). In at least one embodiment, the pillow portion 24 is also contoured for ergonomically conforming to the user's neck N and shoulders S. In at least one embodiment, the pillow portion 24 is constructed out of a relatively flexible material, such as fabric, mesh, plastic or rubber for example. In further embodiments, the pillow portion 24 may be constructed out of any other material (or combination of materials)—now known or later developed—capable of allowing the pillow portion 24 to substantially carry out the functionality described herein.

Figure 3:
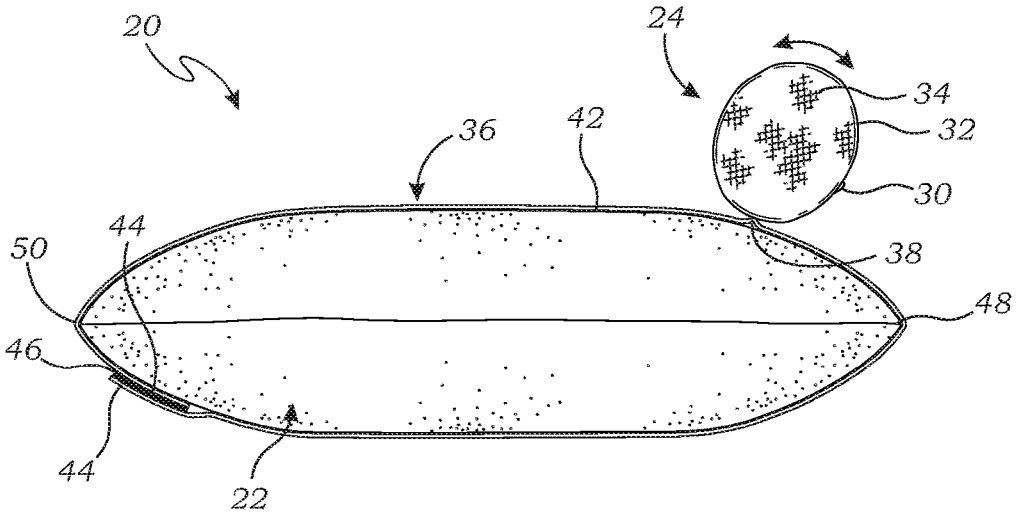
FIG. 3 is a side view thereof, in accordance with at least one embodiment.

In at least one embodiment, as illustrated in FIG. 1, the pillow portion 24 is configured for selectively receiving a cushion 26 therewithin, such that the cushion 26 may be selectively removed in order to wash the apparatus 20. In at least one such embodiment, the pillow portion 24 provides an opening 28 sized and configured for allowing the cushion 26 to pass therethrough. Additionally, in at least one such embodiment, the opening 28 provides an at least one closure mechanism 30 positioned and configured for selectively sealing the opening 28, thereby retaining the cushion 26 within the pillow portion 24. In at least one embodiment, the closure mechanism 30 is a zipper. In further embodiments, the closure mechanism 30 comprises hook-and-loop fasteners, buttons, buckles, snaps, or magnets. In still further embodiments, the closure mechanism 30 may comprise any other mechanism (or combination of mechanisms)—now known or later developed—capable of selectively sealing the opening 28. In at least one embodiment, the opening 28 is positioned on a side wall 32 of the pillow portion 24 and extends longitudinally relative to the pillow portion 24. In at least one such embodiment, as illustrated in FIGS. 3-5, the opening 28 is positioned on an underside of the pillow portion 24, so as to be positioned substantially opposite the user U (thereby not coming into contact with the user U) during use of the apparatus 20. In at least one alternate embodiment, the opening 28 is positioned on an end 34 of the pillow portion 24. In still further embodiments, the opening 28 may take on any other size, shape or position—now known or later developed—capable of allowing the cushion 26 to pass therethrough. In at least one further alternate embodiment, the cushion 26 is permanently positioned within the pillow portion 24. In at least one still further alternate embodiment, the cushion 26 and the pillow portion 24 are one and the same.

In at least one embodiment, the cushion 26 is made of a deformable material capable of ergonomically conforming to the user's neck N and shoulders S while still providing the necessary support to the user's neck N and maintaining neutral cervical alignment—both when the user U is lying in a supine position or a side position. Examples of such deformable materials include (but are in no way limited to) foam, down, feathers, buckwheat, polyester, shredded memory foam, or any other material (or combination of materials)—now known or later developed—capable of providing the necessary comfort and support to the user's neck N. Thus, while the cushion 26 is depicted as being a substantially cylindrical foam material in the drawings, in further embodiments, the cushion 26 may take on any other appropriate size, shape, dimensions and/or materials. In at least one alternate embodiment, the cushion 26 is a bladder capable of being selectively filled with air and/or water, thereby allowing the user U to selectively adjust the density of the cushion 26.

Figure 2:
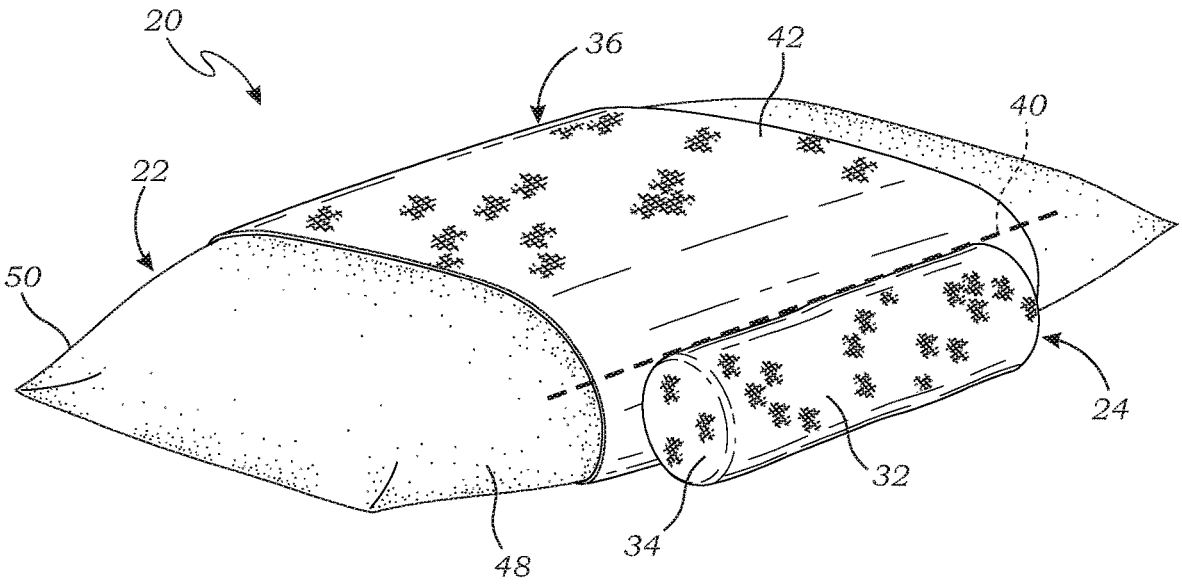
FIG. 2 is a perspective view of the exemplary neck pillow apparatus removably engaged with a main pillow, in accordance with at least one embodiment.
Figure 7:
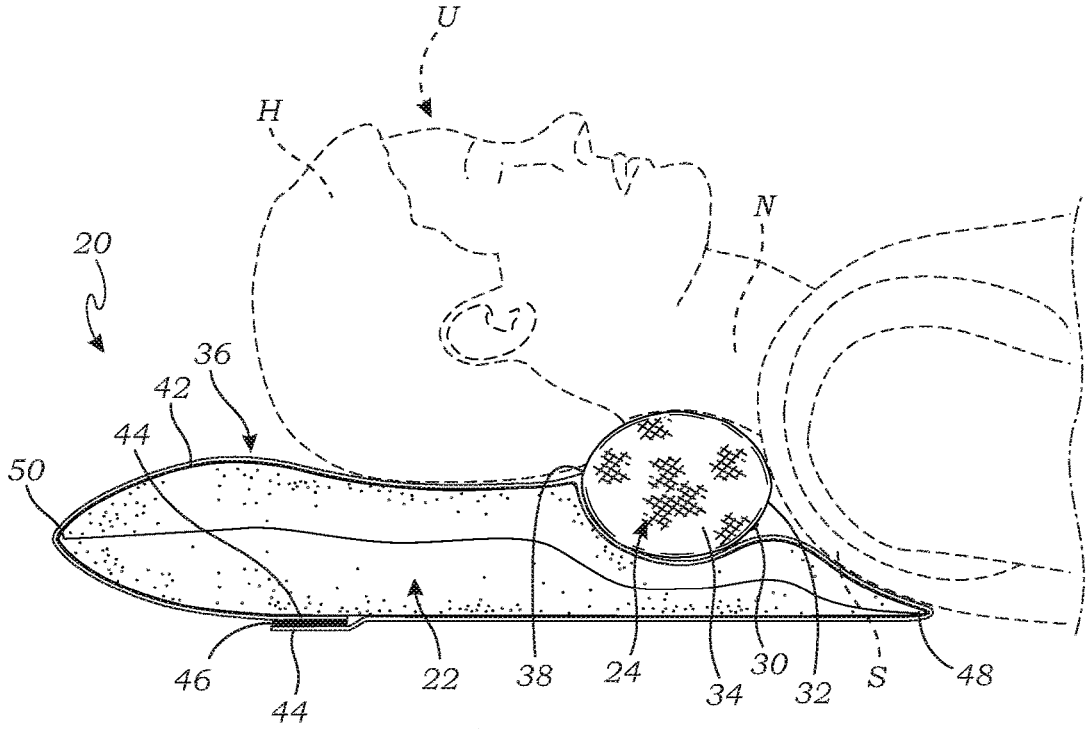
FIG. 7 is a further side view thereof, illustrating the exemplary neck pillow apparatus in use, in accordance with at least one embodiment.

With continued reference to FIG. 1, in at least one embodiment, the apparatus 20 provides an engagement portion 36 connected to the pillow portion 24 and configured for being selectively wrapped laterally around the main pillow 22 (as illustrated in FIGS. 2-7), such that the pillow portion 24 is oriented substantially horizontal relative to the main pillow 22 (as illustrated best in FIGS. 2 and 6)—thereby removably securing the apparatus 20 to the main pillow 22 during use of the apparatus 20. In at least one such embodiment, as best illustrated in FIGS. 2 and 3, the engagement portion 36 is connected to the pillow portion 24 at an at least one point 38 on or substantially proximal to a longitudinally extending centerline 40 of the pillow portion 24, thereby allowing the pillow portion 24 to closely pivot, or roll, longitudinally about the centerline 40 relative to the engagement portion 36 (FIG. 3) during use of the apparatus 20—the purpose of which is discussed further below. In at least one such embodiment, the engagement portion 36 is connected to the pillow portion 24 along an at least one longitudinally extending seam 52—using stitching, welding or any other technique, now known or later developed—on or substantially proximal to the centerline 40 of the pillow portion 24. In at least one such embodiment, as illustrated in FIG. 1, the seam 52 is positioned within the pillow portion 24, so as to create a smooth transition from the engagement portion 36 to the pillow portion 24 during use of the apparatus 20 (as illustrated in FIGS. 4, 5 and 7). In at least one alternate embodiment, the engagement portion 36 is removably connected to the pillow portion 24 using hook-and-loop fasteners, buttons, buckles, snaps, magnets or any other removable engagement mechanisms (or combination of mechanisms), now known or later developed, positioned on or substantially proximal to the centerline 40 of the pillow portion 24.

In at least one embodiment, the engagement portion 36 comprises an elongate sheet 42 of material, with longitudinally opposing ends 44 of the sheet 42 providing an at least one pair of complementary fasteners 46 positioned and configured for engagement with one another when the ends 44 of the sheet 42 are overlapped. In this way, the engagement portion 36 is capable of being wrapped around the main pillow 22 and engaged with itself, thereby maintaining the pillow portion 24 in the desired position relative to the main pillow 22 during use of the apparatus 20. Additionally, in at least one embodiment, as best illustrated in FIGS. 3, 4, 5 and 7, the fasteners 46 are positioned such that when the engagement portion 36 is engaged about the main pillow 22, the fasteners 46 are positioned substantially underneath the main pillow 22 (i.e., substantially sandwiched between the main pillow 22 and a surface on which the main pillow 22 is positioned), thereby better ensuring that the fasteners 46 do not become unintentionally disengaged from one another during use of the apparatus 20. In at least one embodiment, the fasteners 46 are hook-and-loop fasteners. In further embodiments, the fasteners 46 may comprise buttons, buckles, snaps, magnets, or any other mechanism (or combination of mechanisms), adjustable or otherwise—now known or later developed—capable of removable engagement with one another. In at least one embodiment, the sheet 42 is constructed out of a relatively flexible material, such as fabric, mesh, plastic or rubber for example. In further embodiments, the sheet 42 may be constructed out of any other material (or combination of materials)—now known or later developed—capable of allowing the sheet 42 to substantially carry out the functionality described herein. In at least one alternate embodiment, rather than the engagement portion 36 comprising an elongate sheet 42, the engagement portion 36 instead comprises one or more elongate straps, with opposing ends of each strap providing at least one pair of complementary fasteners positioned and configured for engagement with one another when the ends of each strap are overlapped. In still further alternate embodiments, the engagement portion 36 may take on any other size, shape, dimensions and/or configurations—now known or later developed—capable of allowing the engagement portion 36 to substantially carry out the functionality described herein (namely, allowing the pillow portion 24 to be removably engaged with the main pillow 22 in a substantially horizontal orientation relative to the main pillow 22). In an at least one further alternate embodiment, the engagement portion 36 simply comprises one or more fasteners, adjustable or otherwise, positioned on or substantially proximal to the centerline 40 of the pillow portion 24 and configured for being removably engaged with complimentary fasteners positioned on the main pillow 22, thereby allowing the pillow portion 24 to closely pivot, or roll, laterally relative to the main pillow 22 (i.e., between laterally opposing first and second edges 48 and 50 of the main pillow 22) during use of the apparatus 20.

During use of the apparatus 20, as illustrated in FIGS. 2-7, the pillow portion 24 is capable of being selectively positionable relative to the main pillow 22, such that the pillow portion 24 is essentially able to be laterally positioned, relative to the main pillow 22, anywhere between opposing lateral first and second edges 48 and 50 of the main pillow 22—though in most cases, depending on the size of the user U, the pillow portion 24 will be positioned proximal the first edge 48 of the main pillow 50. This ability to be selectively positionable allows the apparatus 20 to be engaged with the main pillow 22 in an ideal support position for each given user U (providing neutral cervical alignment and support to the user's neck N)—regardless of the user's U size, and regardless of whether the user U desires to lay in a supine position or a side position. Furthermore, the engagement portion's 36 ability to be selectively wrapped around the main pillow 22 allows the apparatus 20 to provide such universal functionality regardless of the specific dimensions of the main pillow 22. In other words, the user U is able to use their own pre-existing main pillow 22 with the apparatus 20—or even travel with the apparatus 20, with the confidence of knowing that the apparatus 20 will function properly with any main pillow 22 that the user U might encounter during their travels. And given that the engagement portion 36 wraps around the main pillow 22, a length of the engagement portion 36 is substantially sandwiched between the main pillow 22 and the surface on which the main pillow 22 is positioned during use of the apparatus 20, with the further weight of the user's head H and neck N assisting to prevent the pillow portion 24 from unintentionally shifting.

Additionally, as mentioned above, because the engagement portion 36 is connected to the pillow portion 24 on or substantially proximal to the centerline 40 of the pillow portion 24 in at least one embodiment, the pillow portion 24 is able to closely pivot, or roll, longitudinally about the centerline 40 relative to the engagement portion 36 (FIG. 3) during use of the apparatus 20. As such, when the pillow portion 24 is positioned proximal the first edge 48 of the main pillow 22 (FIGS. 2 and 3), the pillow portion 24 is able to pivot, or roll, longitudinally about the centerline 40 relative to the engagement portion 36 (downwardly toward the surface on which the main pillow 22 is positioned) as the user's neck N comes into contact with the pillow portion 24 (FIGS. 4 and 5), thereby better conforming to the user's neck N in a position that will comfortably provide proper neutral cervical alignment and support to the user's neck N.

Aspects of the present specification may also be described as the following embodiments:

1. A neck pillow apparatus configured for being selectively positionable and removably engagable with a main pillow, the apparatus comprising: a substantially cylindrical pillow portion sized and configured for supporting a neck of a user in either a supine position or side position; a cushion configured for being removably positionable within the pillow portion; and an engagement portion connected to the pillow portion at an at least one point on or substantially proximal to a longitudinally extending centerline of the pillow portion, thereby allowing the pillow portion to closely pivot longitudinally about the centerline relative to the engagement portion, the engagement portion configured for being selectively wrapped laterally around the main pillow, such that the pillow portion is oriented substantially horizontal relative to the main pillow; whereby, during use of the apparatus, the pillow portion is capable of being selectively positionable between opposing lateral first and second edges of the main pillow so as to comfortably provide proper neutral cervical alignment and support to the neck of the user, regardless of whether the user is laying in a supine position or side position.

2. The neck pillow apparatus according to embodiment 1, wherein the pillow portion is contoured for ergonomically conforming to the neck and shoulders of the user.

3. The neck pillow apparatus according to embodiments 1-2, wherein the pillow portion is constructed out of a relatively flexible material.

4. The neck pillow apparatus according to embodiments 1-3, wherein the pillow portion is constructed out of at least one of fabric, mesh, plastic and rubber.

5. The neck pillow apparatus according to embodiments 1-4, wherein the pillow portion provides an opening sized and configured for allowing the cushion to pass therethrough.

6. The neck pillow apparatus according to embodiments 1-5, wherein the opening provides an at least one closure mechanism positioned and configured for selectively sealing the opening, thereby retaining the cushion within the pillow portion.

7. The neck pillow apparatus according to embodiments 1-6, wherein the closure mechanism comprises at least one of a zipper, hook-and-loop fasteners, buttons, buckles, snaps, and magnets.

8. The neck pillow apparatus according to embodiments 1-7, wherein the opening is positioned on a side wall of the pillow portion and extends longitudinally relative to the pillow portion.

9. The neck pillow apparatus according to embodiments 1-8, wherein the opening is positioned on an underside of the pillow portion, so as to be positioned substantially opposite the user during use of the apparatus.

10. The neck pillow apparatus according to embodiments 1-9, wherein the opening is positioned on an end of the pillow portion.

11. The neck pillow apparatus according to embodiments 1-10, wherein the cushion is made of a deformable material capable of ergonomically conforming to the neck and shoulders of the user while still providing the necessary support to the neck of the user for maintaining neutral cervical alignment during use of the apparatus.

12. The neck pillow apparatus according to embodiments 1-11, wherein the cushion comprises at least one of foam, down, feathers, buckwheat, polyester, and shredded memory foam.

13. The neck pillow apparatus according to embodiments 1-12, wherein the cushion is a bladder capable of being selectively filled with air and/or water, thereby allowing the user to selectively adjust the density of the cushion.

14. The neck pillow apparatus according to embodiments 1-13, wherein the engagement portion is connected to the pillow portion along an at least one longitudinally extending seam on or substantially proximal to the centerline of the pillow portion.

15. The neck pillow apparatus according to embodiments 1-14, wherein the at least one seam is positioned within the pillow portion, so as to create a smooth transition from the engagement portion to the pillow portion during use of the apparatus.

16. The neck pillow apparatus according to embodiments 1-15, wherein the engagement portion is removably connected to the pillow portion.

17. The neck pillow apparatus according to embodiments 1-16, wherein the engagement portion is removably connected to the pillow portion using at least one of hook-and-loop fasteners, buttons, buckles, snaps, and magnets positioned on or substantially proximal to the centerline of the pillow portion.

18. The neck pillow apparatus according to embodiments 1-17, wherein the engagement portion comprises an elongate sheet of material, with longitudinally opposing ends of the sheet providing an at least one pair of complementary fasteners positioned and configured for engagement with one another when the ends are overlapped.

19. The neck pillow apparatus according to embodiments 1-18, wherein the at least one pair of fasteners comprises at least one of hook-and-loop fasteners, buttons, buckles, snaps, and magnets.

20. The neck pillow apparatus according to embodiments 1-19, wherein the sheet is constructed out of a relatively flexible material.

21. The neck pillow apparatus according to embodiments 1-20, wherein the sheet is constructed out of at least one of fabric, mesh, plastic and rubber.

22. The neck pillow apparatus according to embodiments 1-21, wherein the engagement portion comprises an at least one elongate strap, with opposing ends of the at least one strap providing an at least one pair of complementary fasteners positioned and configured for engagement with one another when the ends are overlapped.

23. The neck pillow apparatus according to embodiments 1-22, wherein the at least one pair of fasteners comprises at least one of hook-and-loop fasteners, buttons, buckles, snaps, and magnets.

24. A neck pillow apparatus configured for being selectively positionable and removably engagable with a main pillow, the apparatus comprising: a substantially cylindrical pillow portion sized and configured for supporting a neck of a user in either a supine position or side position, the pillow portion providing a cushion; and an engagement portion connected to the pillow portion at an at least one point on or substantially proximal to a longitudinally extending centerline of the pillow portion, thereby allowing the pillow portion to closely pivot longitudinally about the centerline relative to the engagement portion, the engagement portion configured for being selectively wrapped laterally around the main pillow, such that the pillow portion is oriented substantially horizontal relative to the main pillow; whereby, during use of the apparatus, the pillow portion is capable of being selectively positionable between opposing lateral first and second edges of the main pillow so as to comfortably provide proper neutral cervical alignment and support to the neck of the user, regardless of whether the user is laying in a supine position or side position.

25. A neck pillow apparatus configured for being selectively positionable and removably engagable with a main pillow, the apparatus comprising: a substantially cylindrical pillow portion sized and configured for supporting a neck of a user in either a supine position or side position, the pillow portion providing a cushion; an engagement portion connected to the pillow portion along an at least one longitudinally extending seam on or substantially proximal to a longitudinally extending centerline of the pillow portion, thereby allowing the pillow portion to closely pivot longitudinally about the centerline relative to the engagement portion, the engagement portion comprising an elongate sheet of material configured for being selectively wrapped laterally around the main pillow, such that the pillow portion is oriented substantially horizontal relative to the main pillow; and an at least one pair of complementary fasteners positioned on longitudinally opposing ends of the sheet and configured for engagement with one another when the ends are overlapped; whereby, during use of the apparatus, the pillow portion is capable of being selectively positionable between opposing lateral first and second edges of the main pillow so as to comfortably provide proper neutral cervical alignment and support to the neck of the user, regardless of whether the user is laying in a supine position or side position.

In closing, regarding the exemplary embodiments of the present invention as shown and described herein, it will be appreciated that a neck pillow apparatus is disclosed and configured for being selectively positionable and removably engagable with a main pillow. Because the principles of the invention may be practiced in a number of configurations beyond those shown and described, it is to be understood that the invention is not in any way limited by the exemplary embodiments, but is generally directed to a neck pillow apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A neck pillow apparatus configured for being selectively positionable and removably engagable with a main pillow, the apparatus comprising:

a pillow portion sized and configured for supporting a neck of a user in either a supine position or side position, the pillow portion providing a cushion; and an engagement portion directly abutting and connected to a side wall of the pillow portion at an at least one point on or substantially proximal to a longitudinally extending centerline of the pillow portion, thereby allowing the pillow portion to closely pivot longitudinally about the centerline relative to the engagement portion, the engagement portion configured for being selectively wrapped laterally around the main pillow, such that the pillow portion is oriented substantially horizontal relative to the main pillow;

whereby, during use of the apparatus, the pillow portion is capable of being selectively positionable between laterally opposing first and second edges of the main pillow so as to comfortably provide proper neutral cervical alignment and support to the neck of the user, regardless of whether the user is laying in a supine position or side position.

2. The neck pillow apparatus of claim 1, wherein the pillow portion is contoured for ergonomically conforming to the neck and shoulders of the user.

3. The neck pillow apparatus of claim 1, wherein the pillow portion is constructed out of a relatively flexible material.

4. The neck pillow apparatus of claim 3, wherein the pillow portion is constructed out of at least one of fabric, mesh, plastic and rubber.

5. The neck pillow apparatus of claim 1, wherein:

the cushion is configured for being removably positionable within the pillow portion; and the pillow portion provides an opening sized and configured for allowing the cushion to pass therethrough.

6. The neck pillow apparatus of claim 5, wherein the opening provides an at least one closure mechanism positioned and configured for selectively sealing the opening, thereby retaining the cushion within the pillow portion.

7. The neck pillow apparatus of claim 5, wherein the opening is positioned on the side wall of the pillow portion and extends longitudinally relative to the pillow portion.

8. The neck pillow apparatus of claim 7, wherein the opening is positioned on an underside of the pillow portion, so as to be positioned substantially opposite the user during use of the apparatus.

9. The neck pillow apparatus of claim 1, wherein the cushion is made of a deformable material capable of ergonomically conforming to the neck and shoulders of the user while still providing the necessary support to the neck of the user for maintaining neutral cervical alignment during use of the apparatus.

10. The neck pillow apparatus of claim 9, wherein the cushion comprises at least one of foam, down, feathers, buckwheat, polyester, and shredded memory foam.

11. The neck pillow apparatus of claim 1, wherein the cushion is a bladder capable of being selectively filled with air and/or water, thereby allowing the user to selectively adjust the density of the cushion.

12. The neck pillow apparatus of claim 1, wherein the engagement portion is connected to the pillow portion along an at least one longitudinally extending seam on or substantially proximal to the centerline of the pillow portion.

13. The neck pillow apparatus of claim 12, wherein the at least one seam is positioned within the pillow portion, so as to create a smooth transition from the engagement portion to the pillow portion during use of the apparatus.

14. The neck pillow apparatus of claim 1, wherein the engagement portion is removably connected to the pillow portion.

15. The neck pillow apparatus of claim 1, wherein the engagement portion comprises an elongate sheet of material, with longitudinally opposing ends of the sheet providing an at least one pair of complementary fasteners positioned and configured for engagement with one another when the ends are overlapped.

16. The neck pillow apparatus of claim 15, wherein the sheet is constructed out of a relatively flexible material.

17. The neck pillow apparatus of claim 16, wherein the sheet is constructed out of at least one of fabric, mesh, plastic and rubber.

18. The neck pillow apparatus of claim 1, wherein the engagement portion comprises an at least one elongate strap, with opposing ends of the at least one strap providing an at least one pair of complementary fasteners positioned and configured for engagement with one another when the ends are overlapped.

19. A neck pillow apparatus configured for being selectively positionable and removably engagable with a main pillow, the apparatus comprising:

a pillow portion sized and configured for supporting a neck of a user in either a supine position or side position, the pillow portion providing a cushion;

an engagement portion comprising an elongate sheet of material providing an at least one pair of complementary fasteners positioned on longitudinally opposing ends of the sheet, the engagement portion configured for being selectively wrapped laterally around the main pillow with the fasteners selectively engaging one another, such that the engagement portion forms an open-ended, substantially cylindrical structure through which longitudinally opposing ends of the main pillow may extend; and the pillow portion directly connected to the engagement portion at an at least one point on or substantially proximal to a longitudinally extending centerline of the pillow portion, such that the pillow portion is oriented substantially horizontal relative to the main pillow, thereby allowing the pillow portion to closely pivot longitudinally about the centerline relative to the engagement portion;

whereby, during use of the apparatus, the pillow portion is capable of being selectively positionable between laterally opposing first and second edges of the main pillow so as to comfortably provide proper neutral cervical alignment and support to the neck of the user, regardless of whether the user is laying in a supine position or side position.

20. A neck pillow apparatus configured for being selectively positionable and removably engagable with a main pillow, the apparatus comprising:

a pillow portion sized and configured for supporting a neck of a user in either a supine position or side position, the pillow portion providing a cushion;

an engagement portion comprising an elongate sheet of material providing an at least one pair of complementary fasteners positioned on longitudinally opposing ends of the sheet, the engagement portion configured for being selectively wrapped laterally around the main pillow with the fasteners selectively engaging one another, such that the engagement portion forms an open-ended, substantially cylindrical structure through which longitudinally opposing ends of the main pillow may extend; and the pillow portion connected to the engagement portion at an at least one point on or substantially proximal to a longitudinally extending centerline of the pillow portion, such that the pillow portion is oriented substantially horizontal relative to the main pillow, thereby allowing the pillow portion to closely pivot longitudinally about the centerline relative to the engagement portion;

whereby, during use of the apparatus, the pillow portion is capable of being selectively positionable between laterally opposing first and second edges of the main pillow so as to comfortably provide proper neutral cervical alignment and support to the neck of the user, regardless of whether the user is laying in a supine position or side position.

* * * * *